United States Patent [19]

Zippel

[11] 4,147,257

[45] Apr. 3, 1979

[54] DEVICE FOR JOINING CONSOLIDATED LAMELLAR MATERIAL

[75] Inventor: Herbert Zippel, Altdorf b. Nüremberg, Fed. Rep. of Germany

[73] Assignee: Herbert Zippel GmbH & Co., Nüremberg, Fed. Rep. of Germany

[21] Appl. No.: 817,824

[22] Filed: Jul. 21, 1977

[30] Foreign Application Priority Data

Sep. 8, 1976 [DE] Fed. Rep. of Germany ..... 2640438

[51] Int. Cl.[2] ..... A47F 5/08; B42F 1/00

[52] U.S. Cl. ..... 211/45; 24/67.1; 211/113

[58] Field of Search ..... 211/45–48, 211/113; 24/251, 263 B, 67 R, 67.1, 67.7; 402/46, 73–79; 312/184

[56] References Cited

U.S. PATENT DOCUMENTS

| | | | |
|---|---|---|---|
| 2,622,300 | 12/1952 | Marziani | 211/45 X |
| 2,985,174 | 5/1961 | Guth | 24/67.1 |
| 3,308,831 | 3/1967 | Kritske | 24/67.1 |
| 3,896,526 | 7/1975 | Joiner | 24/67.1 |

*Primary Examiner*—Roy D. Frazier
*Assistant Examiner*—Terrell P. Lewis
*Attorney, Agent, or Firm*—Darby & Darby

[57] ABSTRACT

An apparatus is provided for retaining lamellar material in stacked form. The device includes a sectional rail with a J-shaped cross section, which rail forms the main body of the device. The retaining action of the device is provided by a clamping rail with an L-shaped cross section. In the vicinity of its apex, the L-shaped clamping rail is pivotally mounted at the end of the shorter leg of the J-shaped sectional rail so that the longer legs of the two rails are in opposed, spaced relationship with the shorter leg of the L-shaped rail extending therebetween. An actuating member is coupled to the shorter leg of the L-shaped clamping rail and includes a threaded shaft which extends through a hole in the arcuate or web portion of the J-shaped sectional rail. The threaded shaft is capped with a wing nut which permits adjustment of the device. In operation, the stack of lamellar material is inserted between the longer legs of the two rails and the wing nut is screwed down onto the threaded shaft. This causes the shorter leg of the L-shaped clamping rail to be drawn towards the web of the sectional rail, whereby the clamping member is pivoted so that the two longer legs of the rails clamp the lamellar material between them.

27 Claims, 6 Drawing Figures

DEVICE FOR JOINING CONSOLIDATED LAMELLAR MATERIAL

This invention relates to a device for joining consolidated, stacked lamellar material, in particular drawings, wall-papers, fabric patterns and the like.

One prior art joining device includes a main body or sectional rail which is made by forming flat material to have a generally J-shaped cross section. The clamping member or rail of the device is made by forming flat material into an angle element having two legs of substantially equal length defining an acute angle in cross section. At its free end, one of these legs is adapted to be mounted on a pin for pivotal movement thereabout. This pin forms the cross member of a T-screw in which the vertical member is a threaded shaft which passes through a hole in the arcuate portion or web of the J-shaped sectional rail and is provided with a wing nut. When the device is assembled, one leg of the clamping rail is pivotally mounted between the legs of the J-shaped sectional rail so that the acute angle of the clamping rail opens towards the longer leg of the J-shaped sectional rail. As the wing nut is tightened, the end of the clamping rail is drawn towards the web. As a result, the shorter leg of the J-shaped sectional rail bears on the pivotally mounted leg of the clamping member so as to pivot the clamping rail and urge the other (free) leg toward the longer leg of the sectional rail. If a stack of lamellar material is placed between the longer leg of the sectional rail and the clamping member, it is clamped therebetween as the wing nut is tightened.

When the device is employed with a stack of consolidated material with the greatest possible thickness, the free leg of the clamp rail is most remote from the longer leg of the J-shaped sectional rail and is generally parallel thereto. The pivotally mounted end of the other leg of the clamp rail, however, is close to the inner edge of the shorter leg of the J-shaped sectional rail. The distance from the free longitudinal edge of the shorter leg to the pivotally mounted end is smallest in this case and, due to this short lever arm, the pivotal force or torque exerted on the clamp rail by the free longitudinal edge of the shorter leg of the section rail is only small as well. In order to enclose or join the sheets of a thick stack of consolidated material, a very great force must, therefore, be exerted in the case of the prior art device, which presupposes an appropriately strong operator. In addition, the pivotally mounted leg rubs on the free longitudinal edge of the shorter leg of the sectional rail, with this great force, so that there is, in addition, a significant amount of wear and the external appearance of the clamp rail is impaired or damaged.

It is a primary object of the invention to provide a device for enclosing or joining consolidated lamellar material which includes an adjustable device that is almost always effective with the largest and longest possible lever arm in order to enclose or join a stack of the largest possible thickness.

This object is accomplished in accordance with the invention in that an adjustable actuating device acts on the shorter leg of a clamp rail which has an L-shaped cross section with legs of unequal length. An external ridge-like projection, proximate to the apex of the L, is pivotally supported at the free longitudinal edge of the shorter leg of the sectional rail.

Due to this construction, the force exerted by the adjustable device, especially when enclosing a stack of maximum thickness, almost always acts perpendicularly to the shorter leg of the L-shaped clamp rail, so that the greatest possible pivotal force is always produced without excessive losses due to friction. Thus, the free longitudinal edge of the longer leg of the clamp rail is pressed against the stack to be closed or joined with the greatest possible force. In particular, no signs of wear which would impair the appearance, among other things, occur with a device designed in accordance with the invention.

The adjustable actuating device is preferably formed by at least one T-screw which is articulately anchored on the shorter leg of the clamp rail, passes through the web of the J-shaped sectional rail with clearance and has a manipulating member, similar to a wing nut, on the free threaded shaft projecting through the sectional rail.

Such an adjustable device which is known per se is simple in construction and accordingly economical in production. It, like the joining device itself, comprises only two parts which are assembled with effortless ease.

In detail, the construction is executed so that the shorter leg of the sectional rail, of J-shaped cross section, has a groove of circular cross-section adjacent its free longitudinal edge or in its side. This groove is adapted to receive the projection of the clamp rail of L-shaped cross section, the projection having approximately the same cross section as the groove and being designed to be insertable into the groove from the face end.

Owing to the projection provided on the clamp rail, about three-quarters of which projection corresponds to a round bar, the clamp rail is supported on the shorter leg of the J-shaped sectional rail free of twist and torsion and can not fall out of its position, unlike in the known device, when the adjustable device has not been assembled or mounted. The assembly of the adjustable device is thus simplified in this way.

The invention will now be explained in more detail with reference to a preferred, but nonetheless illustrative, embodiment which reveals other inventive features. In the drawing.

Figure 1:
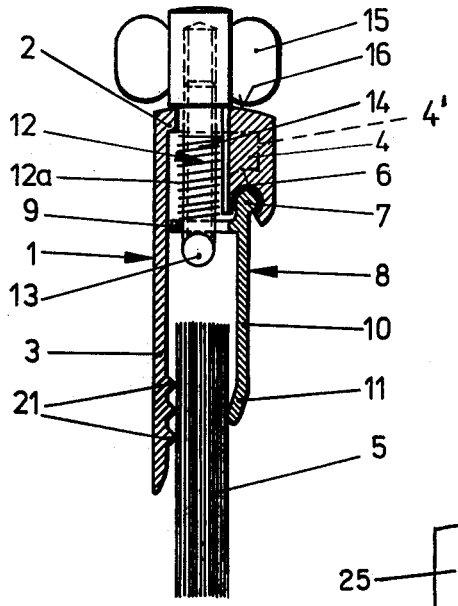
FIG. 1 shows a side cross-sectional view through the preferred device for joining consolidated lamellar material.

In one preferred embodiment (FIG. 1), the device for joining consolidated lamellar material, in particular drawings, wallpapers, fabric patterns and the like, is formed by a sectional rail 1 which is generally J-shaped in cross section and which may consist of aluminum, plastic or the like. Two legs 3 and 4 are formed on the web 2 of rail 1 and are of unequal length. The consolidated lamellar material 5 is pressed against the longer leg 3. The shorter leg 4 is designed to be considerably thicker than either the thickness of the web 2 or the longer leg 3. An open-edged cylindrical groove 6 is formed in the free narrow side of this thickened shorter leg 4 and has an opening which is substantially smaller than the diameter of the groove. It is arranged such that the opening extends somewhat laterally towards the longer leg 3 and, at the same time, extends somewhat toward the open bottom (FIG. 1) of the sectional rail 1.

An L-shaped clamp rail 8 having legs 9 and 10, which are of unequal length in cross-section, includes a ridge-like projection 7 with a cross-section which is approximately the same as the cross-section of the circular groove 6. Projection 7 is positioned in groove 6 and is formed externally adjacent the apex of the clamp rail 8, or on the longer leg 10 which projects somewhat beyond the shorter leg 9. The ridge-like projection 7, which is circular in cross-section, has a diameter which is considerably larger than the wall thickness of the clamp rail 8 and the opening in the circular groove 6 of the thicker leg 4 of the J-shaped sectional rail 1. Thus, the projection 7 of the clamp rail may be inserted only from the front or rear (in FIG. 1) of the sectional rail into the groove 6 of the shorter leg 4, in which groove the clamp rail 8 can then be pivoted similar to a hinge, to a limited extent. The free longitudinal edge 11 of the longer leg 10 is bent inwardly in a somewhat inclined manner to produce a clamping edge so that the consolidated lamellar material 5 to be joined can be held in position between the clamping edge (the bent longitudinal edge 11 of the clamp rail 8) and the longer leg 3 of the J-shaped sectional rail 1. The length of the shorter leg 9 of the clamp rail 8 is selected so that its free longitudinal edge cannot impede the hinge-like movement of said clamp rail.

Figure 3:
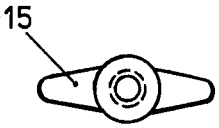
FIG. 3 shows a bottom elevational view of a wing nut.

In order to enclose the consolidated lamellar material 5 in the device, an adjustable device is provided which acts on the shorter leg 9 of the clamp rail, thereby pressing the clamping edge of the longer leg 10 against the consolidated material 5. In the preferred embodiment, the adjustable device comprises a tommy screw (T-screw) 12 whose head, formed for example by a cylindrical transverse pin 13, abuts the inner side of the shorter leg 9 of the clamp rail and whose shaft 14, the majority of which is provided with an external thread, passes through aligned holes in the shorter leg 9 and the web 2 of the U-shaped sectional rail 1. These holes are preferably transverse to the longitudinal axis of the leg 9 and the web 2, so that the T-screw 12 moves along its length when the clamp rail 8 is pivoted and thus cannot impede the pivotability thereof. A wing nut 15 is screwed onto the end of shaft 14 projecting from the web 2 of the J-shaped sectional rail 1 for manual operation of the T-screw in accordance with FIGS. 1 and 3. The wing nut 15 can have a cylindrical member on its underside in order to reduce the frictional surface on the web 2 of the J-shaped sectional rail. The adjustable device is preferably designed such that the wing nut 15 forms a hood to a certain extent and completely encloses the threaded shaft projecting from the web 2 when the clamping edge of leg 10 of the clamp rail 8 completely abuts the leg 3 of the J-shaped sectional rail 1.

The adjustable device can also be formed by a corresponding adapted eccentric mechanism instead of a screw mechanism to actuate the clamp rail.

In order that clamp each clamp rail can be opened rapidly in accordance with the movement of the adjustable device, a helical compression spring 12*a* is disposed on the shaft of each T-screw 12 and has one end on the web 2 of the sectional rail 1 of J-shaped cross section and the other end on the leg 9 of the clamp rail 8 so as to pre-bias them.

Figure 4:
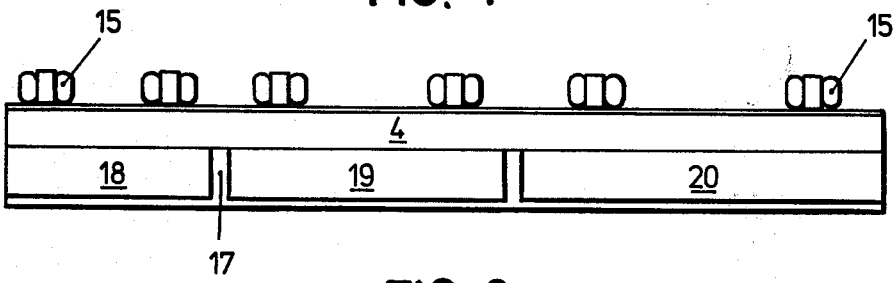
FIG. 4 shows a front elevational view, on a reduced scale, of a device similar to the one in FIG. 1 in which a plurality of clamp rails are provided on a common J-shaped sectional rail to permit simultaneous securement of different width materials.

A plurality of stacks of consolidated lamellar material of different format and size can be joined in an orderly manner by means of the device similar to the one explained above, but modified in accordance with FIG. 4. A J-shaped sectional rail 17 is used for this purpose whose length corresponds approximately to the combined widths of the joined stack of different formats. Such a sectional rail includes a series of longitudinally spaced clamp rails 18, 19 and 20, which are constructed like clamp rail 8 described above. Each of the clamp rails is selected to have a width corresponding to the width of the format to be clamped thereby. The individual clamp rails are then joined to sectional rail 17 by corresponding ridge-like projections inserted into the conforming groove in sectional rail 17 having a similar construction to sectional rail 1. The adjustable actuating device associated with each clamp rail 18, 19 and 20 is then attached, whereupon the consolidated lamellar material corresponding to the respective format can be joined together by the associated clamp rail.

Figure 5:
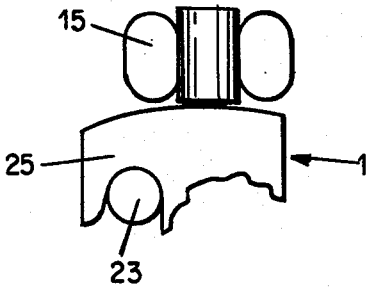
FIG. 5 shows a fragmentary side elevational view of a device similar to the one in FIG. 1 which is adapted to be supported on a rail.
Figure 6:
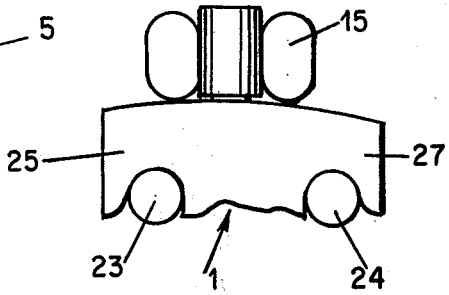
FIG. 6 shows a fragmentary side elevational view of a device similar to the one in FIG. 1 which is adapted to be supported on a pair of parallel rails.
Figure 2:
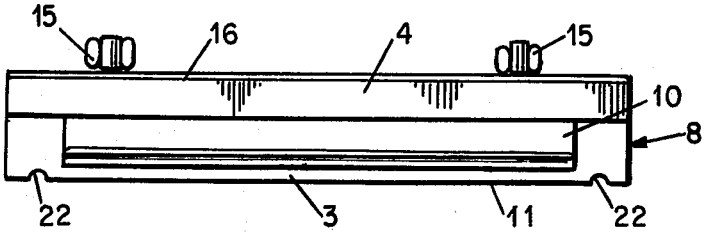
FIG. 2 shows a front elevational view, on a reduced scale, of the device according to FIG. 1.

In order for the device designed in accordance with the invention to be assembled to form a ledger and still save considerable space (e.g., by accommodating it in a hanging file cabinet), the J-shaped sectional rail 1 or 17 is provided, when necessary, with suspension means 25 (FIG. 5), predominantly for pivotal suspended or hanging file cabinets which only require one support rail 23 for series of devices. Each individual device with the J-shaped profile rail extends horizontally along the support rail, but is also arranged perpendicular thereto. A laterally projecting suspension hook 27 (FIG. 6) can also be mounted adjacent the front ends of each device so that port rails 23,24 in order to form a series of devices. Alternatively, the J-shaped sectional rail 1 or 17 can also be extended beyond the width of the respective formats to be joined and open-edged notches 22 can be provided respectively in the longer legs of the extended ends as a mounting member for the support rails (shown in FIG. 2).

Instead of a cylindrical member on the underside of a wing nut 15, the web 2 of the J-shaped sectional rail 1 can be designed to be vaulted in cross section and in the direction of the wing nuts so that the wing nuts cannot become wedged on the vaulted portion 16 when the device is opened and closed.

Several modifications can be made in the construction of rail 1 or 17 to improve its operation. For example, the longer leg 3 of the J-shaped sectional rail 1 can project beyond the longer leg 10 of the clamp rail 8 and be beveled on the inner side towards the free longitudinal edge to ensure easier insertion of the consolidated lamellar material 5 to be joined into the device. Also, elevations, e.g. longitudinally extending ribs 21, can be provided on the inside of the broad leg 3 of the sectional rail 1. These elevations considerably improve the holding of the consolidated material. The thickening of the shorter leg 4 of the sectional rail can be restricted to the area of the groove 6 so that a considerable amount of material 4 can be saved as indicated by the dot-and-dash lines in FIG. 1.

Although specific embodiments of the invention have been disclosed for illustrative purposes, those skilled in the art will appreciate that many additions, modifications and substitutions are possible without departing from the scope and spirit of the invention as defined in the accompanying claims.

What is claimed is:

1. A device for retaining consolidated lamellar material comprising:

a sectional rail having a generally J-shaped cross-section and including long and short leg portions;

a clamp rail having first and second leg portions joined to form a generally L-shaped cross-section and an apex portion corresponding to the juncture of said leg portions;

a channel extending along said short leg and having a predetermined cross-sectional shape, the cross-section of said channel being wider at the interior of said leg than at the surface thereof;

a ridge-like projection extending along said clamp rail in the vicinity of the apex portion thereof, said projection being a continuation of said first leg and having a cross-sectional shape conforming substantially to the cross-section of said short leg channel and being journaled therein;

actuating means acting on said second leg and said sectional rail for selectively pivoting said clamp rail with respect to said sectional rail; and resilient means disposed between said sectional rail and said clamp rail to provide a force therebetween tending to separate said long leg and said first leg;

said lamellar material being retained in said device by being placed between said long leg and said first leg, said actuating means being operated to pivot said clamp rail so that said first leg rotates about a fixed point, said long leg and said first leg clamping said lamellar material therebetween.

2. A device in accordance with claim 1 wherein said longer leg of said sectional rail projects beyond the opposed leg of said clamping rail and, at its projecting extreme, includes a bevelled edge on the surface facing said opposed leg.

3. A device in accordance with claim 1 wherein said actuating means include:

at least one threaded shaft which is articulately anchored to the second leg of said clamping rail and which passes through an oversized opening in said sectional rail so that a portion thereof protrudes beyond said sectional rail; and at least one adjustment means having an internal thread adapted to mate with the thread on said threaded shaft, said adjustment means being threaded onto said shaft to achieve said pivoting of said clamping rail.

4. A device in accordance with claim 3 wherein said adjustment means substantially encloses the protruding end of said threaded shaft.

5. A device in accordance with claim 1 wherein said channel has a cross-sectional shape corresponding substantially to a segment of a circle, said projection being constructed and arranged for insertion into said channel from a longitudinal end of said short leg portion.

6. A device in accordance with claim 5 wherein at least a portion of said short leg is thicker in cross-section than the remainder of said sectional rail, said groove being diposed in said thickened portion and being oriented to be open at least partially in the direction of said long leg.

7. Apparatus in accordance with claim 1 wherein said resilient means exerts a separating force between said second leg and a point on said sectional rail intermediate said long and short legs.

8. A device in accordance with claim 1 wherein the free longitudinal edge of said first leg is bent toward said long leg.

9. A device in accordance with claim 1 wherein the exterior surface of said sectional rail is vaulted outwardly intermediate said long and short legs.

10. A device in accordance with claim 1 wherein at least one rib extends longitudinally along said long leg on the surface thereof facing said first leg to provide increased retention of said lamellar material.

11. A device in accordance with claim 1 which is adapted to be supported from an elongated rail, said device including means formed on one of said long and short leg portions for engaging said rail to support said device therefrom.

12. A device which is adapted to be supported from a pair of substantially parallel elongated rails for retaining consolidated lamellar material, comprising:

a sectional rail having a generally J-shaped cross-section and including long and short leg portions, said sectional rail including first and second suspension means extending respectively from said long and short legs for engaging respective ones of said substantially parallel rails to support said device therefrom;

a clamp rail having first and second leg portions joined to form a generally L-shaped cross-section and an apex portion corresponding to the juncture of said leg portions;

a channel extending along said short leg and having a predetermined cross-sectional shape, the cross-section of said channel being wider at the interior of said leg than at the surface thereof;

a ridge-like projection extending along said clamp rail in the vicinity of the apex portion thereof, said projection being a continuation of said first leg and having a cross-sectional shape conforming substantially to the cross-section of said short leg channel and being journaled therein; and actuating means acting on said second leg and said sectional rail for selectively pivoting said clamp rail with respect to said sectional rail;

said lamellar material being retained in said device by being placed between said long leg and said first leg, said actuating means being operated to pivot said clamp rail so that said first leg rotates about a fixed point, said long leg and said first leg clamping said lamellar material therebetween.

13. A device for simultaneously retaining a plurality of stacks of consolidated lamellar material in side-by-side relationship, comprising:

a sectional rail having a generally J-shaped cross-section and including a short and long leg portion, said sectional rail extending in its longitudinal direction for a distance approximately equal to the sum of the widths of said stacks of lamellar material;

a plurality of clamp rails each corresponding to one of said stacks of lamellar material and extending longitudinally for a distance approximately equal to the width of the corresponding stack of lamellar material, each of said clamp rails having a first and second leg portion joined to define a generally L-shaped cross-section and an apex portion corresponding to the juncture of said leg portions;

means for mounting said clamp rails in a side-by-side arrangement for pivotal movement with respect to said sectional rail, said mounting means mounting each clamp rail in the vicinity of its apex portion to said short leg of said sectional rail so that the first leg thereof is in spaced, opposed relationship with said long leg and the second leg thereof extends between said first leg and said long leg;

actuating means acting on said second legs and said sectional rail for selectively pivoting said clamp rails with respect to said sectional rail; and resilient means disposed between said sectional rail and at least one of said clamp rails to provide a force therebetween tending to separate said long leg and said first legs;

each of said stacks of lamellar material being retained in said device by being placed between said long leg and the first leg of the corresponding clamp rail, said actuating means being operated to pivot each clamp rail so that said long leg and the corresponding first leg clamp the respective stack of lamellar material therebetween.

14. A device in accordance with claim 13 wherein said longer leg of said sectional rail projects beyond the opposed leg of at least one of said clamping rails and, at its projecting extreme, includes a bevelled edge on the surface facing said opposed leg.

15. A device in accordance with claim 13 wherein said actuating means include:

at least one threaded shaft which is articulately anchored to the second leg of a respective clamping rail and which passes through an oversized opening in said sectional rail so that a portion thereof protrudes beyond said sectional rail; and at least one adjustment means having an internal thread adapted to mate with the thread on said threaded shaft, said adjustment means being threaded onto said shaft to achieve said pivoting of the respective clamping rail.

16. A device in accordance with claim 15 wherein said adjustment means substantially encloses the protruding end of said threaded shaft.

17. A retaining device in accordance with claim 13 wherein said mounting means comprises:

a channel extending along said short leg and having a predetermined cross-sectional shape, the cross-section of said channel being wider at the interior of said leg than at the surface thereof; and a ridge-like projection extending along each of said clamp rails in the vicinity of the apex portion thereof, said projection having a cross-sectional shape conforming substantially to the cross-section of said short leg channel and being journaled therein.

18. A device in accordance with claim 17 wherein said channel has a cross-sectional shape corresponding substantially to a segment of a circle, said projection being constructed and arranged for insertion into said channel from a longitudinal end of said short leg portion.

19. A device in accordance with claim 18 wherein at least a portion of said short leg is thicker in cross-section than the remainder of said sectional rail, said groove being disposed in said thickened portion and being oriented to open at least partially in the direction of said long leg.

20. A device in accordance with claim 17 wherein said actuating means include:

at least one threaded shaft which is articulately anchored to the second leg of a respective clamping rail and which passes through an oversized opening in said sectional rail so that a portion thereof protrudes beyond said sectional rail; and at least one adjustment means having an internal thread adapted to mate with the thread on said threaded shaft, said adjustment means being threaded onto said shaft to achieve said pivoting of the respective clamping rail.

21. Apparatus in accordance with claim 13 wherein said resilient means exerts a separating force between the second leg of said at least one clamp rail and a point on said sectional rail intermediate said long and short legs.

22. A device in accordance with claim 13 wherein the free longitudinal edge of at least one of said first legs is bent toward said long leg.

23. A device in accordance with claim 13 wherein the exterior surface of said sectional rail is vaulted outwardly intermediate said long and short legs.

24. A device in accordance with claim 13 wherein at least one rib extends longitudinally along said long leg on the surface thereof facing said first legs to provide increased retention of said lamellar material.

25. A device in accordance with claim 13 which is adapted to be supported from an elongated rail, said device including means formed on one of said long and short leg portions for engaging said rail to support said device therefrom.

26. A device in accordance with claim 13 wherein each projection is a continuation of the corresponding first leg, so that when the actuating means are operated to pivot the corresponding clamp rail, the corresponding first leg rotates about a fixed point.

27. A device which is adapted to be supported from a pair of substantially parallel elongated rails, for simultaneously retaining a plurality of stacks of consolidated lamellar material in side-by-side relationship, comprising:

a sectional rail of generally J-shaped cross-section and including a short and long leg portion, said sectional rail extending in its longitudinal direction for a distance approximately equal to the sum of the width of said stacks of lamellar material, said sectional rail further including first and second suspension means extending respectively from said long and short legs for engaging respective ones of said substantially parallel rails to support said device therefrom;

a plurality of clamp rails each corresponding to one of said stacks of lamellar material and extending longitudinally for a distance approximately equal to the width of the corresponding stack of lamellar material, each of said clamp rails having a first and second leg portion joined to define a generally L-shaped cross-section and an apex portion corresponding to the juncture of said leg portions;

means for mounting said clamp rails in a side-by-side arrangement for pivotal movement with respect to said sectional rail, said mounting means mounting each clamp rail in the vicinity of its apex portion to said short leg of said sectional rail so that the first leg thereof is in spaced, opposed relationship with said long leg and the second leg thereof extends between said first leg and said long leg; and actuating means acting on said second legs and said sectional rail for selectively pivoting said clamp rails with respect to said sectional rail;

each of said stacks of lamellar material being retained in said device by being placed between said long leg and the first leg of the corresponding clamp rail, said actuating means being operated to pivot each clamp rail so that said long leg and the corresponding first leg clamp the respective stack of lamellar material therebetween.

* * * * *